US005486739A

United States Patent [19]

Roberts

[11] Patent Number: 5,486,739

[45] Date of Patent: Jan. 23, 1996

[54] BALLASTING SYSTEM FOR FLUORESCENT LAMPS HAVING IMPROVED ENERGY TRANSFER

[75] Inventor: Gary D. Roberts, Riverton, Utah

[73] Assignee: Remtech, L.C., Lindon, Utah

[21] Appl. No.: 242,417

[22] Filed: May 13, 1994

Related U.S. Application Data

[63] Continuation-in-part of Ser. No. 125,815, Sep. 24, 1993, and a continuation-in-part of Ser. No. 215,257, Mar. 21, 1994.

[51] Int. Cl.[6] ..... H05B 41/16

[52] U.S. Cl. ..... 315/277; 315/255; 315/DIG. 5

[58] Field of Search ..... 315/276, 277, 315/278, 279, 228, 307, 282, 189, 257, 254, 255, 244, 105, 106, 239, DIG. 5, DIG. 2; 336/182, 183

[56] References Cited

U.S. PATENT DOCUMENTS 4,185,233 1/1980 Riesland et al. ..... 315/276
4,399,391 8/1983 Hammer et al. ..... 315/244

*Primary Examiner*—Ali Neyzari
*Attorney, Agent, or Firm*—Robert B. Crouch

[57] ABSTRACT

Ballasting system for fluorescent lamps having improved energy transfer capability and which delivers a sinusoidal current waveform free of high order harmonics and induces a similar waveform into the power distribution system. The system includes a low leakage reactance auto-transformer which is tuned to the line frequency, and a separately-wound heating transformer and means for switching energy from the heating transformer each half cycle.

12 Claims, 2 Drawing Sheets

BALLASTING SYSTEM FOR FLUORESCENT LAMPS HAVING IMPROVED ENERGY TRANSFER

CROSS REFERENCE TO RELATED APPLICATIONS

This application is a continuation-in-part of U.S. patent applications Ser. No. 08/125,815 filed 09/24/93, and Ser. No. 08/215,257 filed 03/21/94.

BACKGROUND OF THE INVENTION

The continuing emphasis on elimination of waste in the use of electricity has produced improvement in the efficiency of electrical appliances and systems. In the area of lighting, which uses 25–30% of the electrical energy generated in the United States, much of the focus for improvement has been on fluorescent lamps. In recent years, substantial improvement in the efficency of the standard electromagnetic, or coil and core, ballasts has been realized, primarily by development of improved core materials. In addition to improved, efficiency, the use of higher quality materials has also limited internal losses and reduced input watts. Further improvement in performance and/or efficiency of the prior art electro-magnetic ballast, however, has become increasingly difficult to achieve. The designs of windings and cores of the typical ballasts have been refined to the point that reduction of copper and/or magnetic losses have become impractical without adverse effect upon energy transfer capability or significant increase in product cost. Accordingly, interest has developed in the use of electronic ballasts which offer increased efficiency and extended lamp life by operation of the lamps at frequencies of 20,000–30,000 Hz instead of the 60 Hz employed in electro-magnetic ballasts.

Efforts to further improve the performance of electromagnetic ballasts have included proposals, such as advanced in U.S. Pat. Nos. 4,399,391 and 5,021,714, to introduce high frequency harmonics into the voltage waveform delivered to the lamps in order to increase the starting voltage experienced at the lamp cathodes.

High order harmonics, which are characteristic of electronic ballasts, are of increasing concern in modern lighting installations since they cause distortion of the sinusoidal shape of the input current waveform of the power distribution system with consequent adverse effects on the operation of such electrically-sensitive equipment as computors, data transfer and retrieval systems, life support systems, telecommunications, etc.

SUMMARY OF THE INVENTION

The present invention provides an efficient electro-magnetic ballast and ballasting system with increased energy transfer capability and reduced copper and magnetic losses and which delivers a sinusoidal current waveform free of high order harmonics, and therefore induces a similar waveform into the power distribution system. This is accomplished by provision of a ballasting system having a low leakage reactance ballasting transformer and a separately-wound cathode heating transformer and means for switching energy from the heating transformer each half cycle with a single switch. The energy transfer capability of the ballasting transformer is increased by the fact that the windings are tuned to the operating frequency of the system, i.e., approximately 50–60 Hz.

DRAWING

Figure 3A:
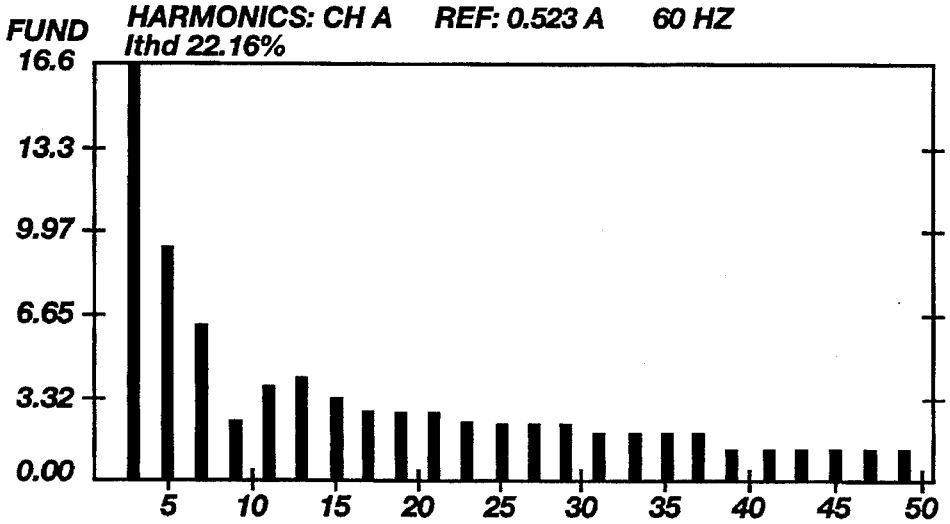

FIG. 3*a* is a graph of the harmonic content of the voltage waveform of a typical commercially available/electronic ballast.

Figure 3B:
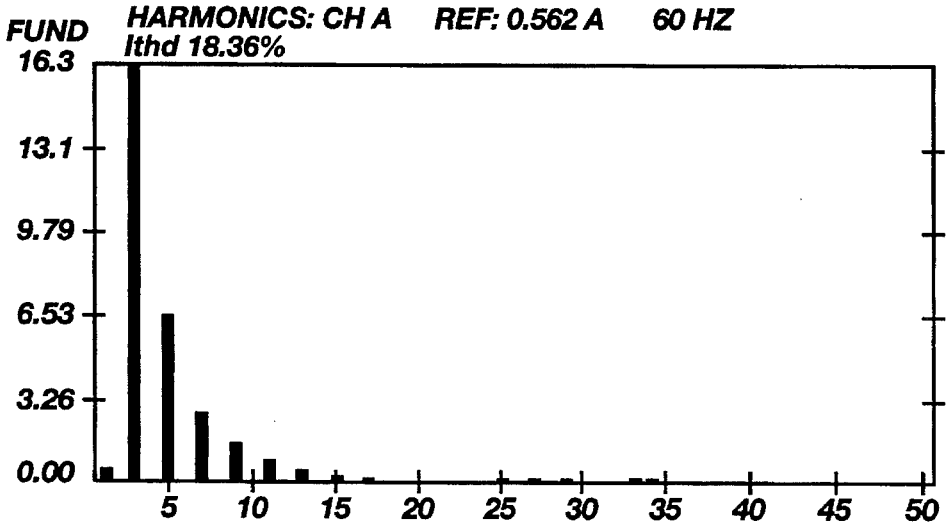

FIG. 3*b* is a graph of the harmonic content of the voltage waveform of the low leakage reactance ballast of the present invention.

DETAILED DESCRIPTION

Figure 1:
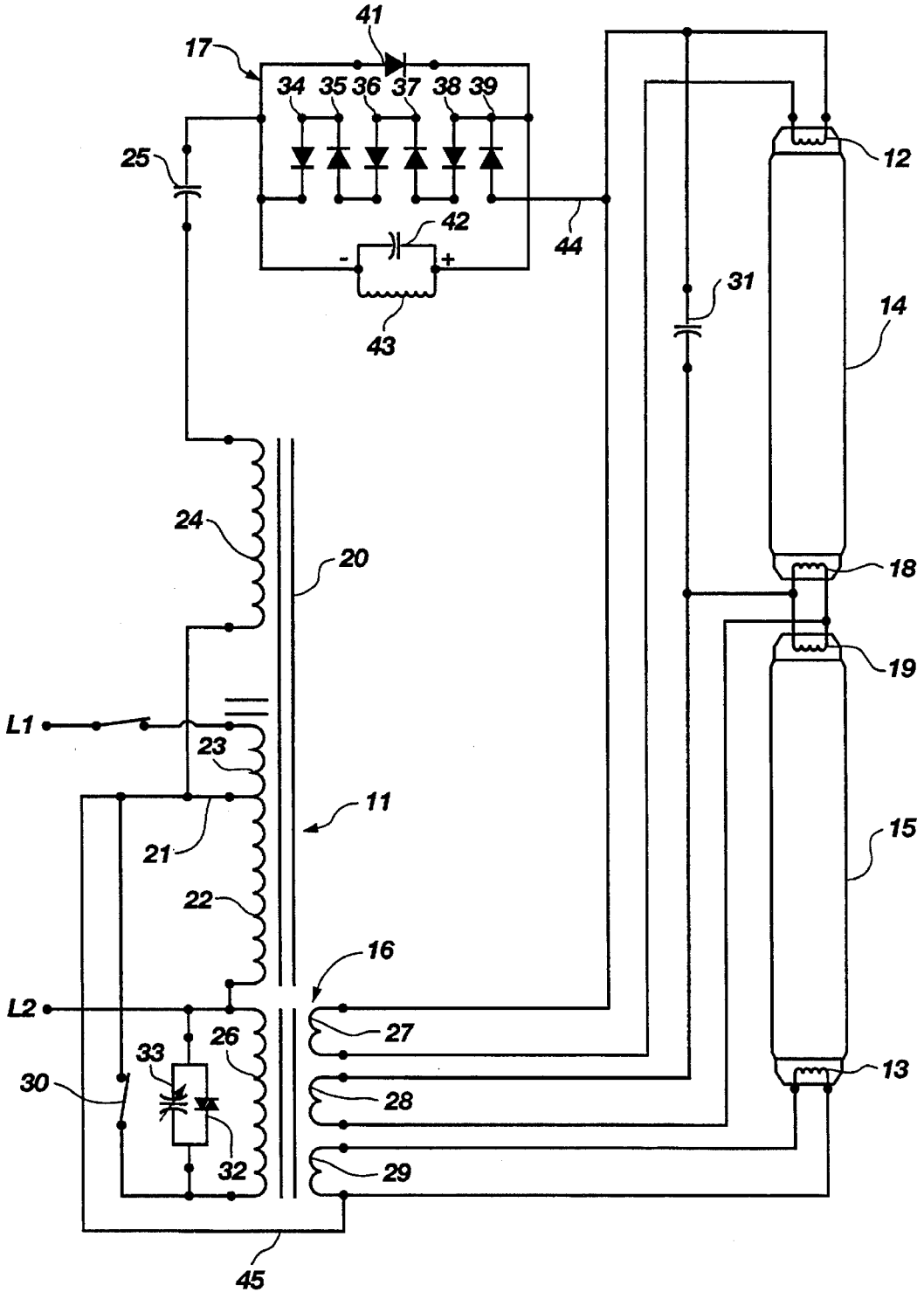
FIG. 1 is a circuit diagram of the present ballasting system.

Referring more particularly to FIG. 1 of the drawing, the ballasting system of the present invention includes a ballasting auto-transformer 11 which is electrically connected to the cathodes 12,13 of a pair of fluorescent lamps 14,15, and a cathode heating transformer 16 and switching array 17 which are connected to cathodes 12,13 & 18,19. The ballasting auto-transformer 11 includes a laminated iron core 20, a main winding which is connected to the a.c. line terminals L1 and L2 and which is tapped at 21 to form primary winding 22 and a tertiary winding 23, plus a secondary winding 24 which is connected to the tap 21 and, through a capacitor 25 and the switching array 17, to cathode 12 of lamp 14. The cathode heating transformer 16 includes a primary winding 26 which is wound on the core 20 and connected between line terminal L2 and, through a normally closed contact 30, to the tap 21. Primary winding 26 may be connected to tap 21 or to another tap (not shown) on the main winding, depending upon the voltage desired. Three supplementary windings 27,28,29 are inductively coupled to the primary winding 26, with winding 27 connected to cathode 12, winding 28 connected to parallel-connected cathodes 18,19, and winding 29 connected to cathode 13. A lamp starting capacitor 31 is connected in parallel with lamp 14 as shown. An RC circuit, which includes a non-linear resistor 32 in parallel with an adjustable capacitance 33, is connected in parallel with primary winding 26. The RC circuit limits arcing across the contact 30 and can be omitted if not needed. The switching array 17 includes a plurality of diodes 34–39 connected in series as to be similarly conductive in the same direction. A single diode 41 is connected in parallel with the diodes 34–39 so as to be conductive in its forward direction in opposite polarity to that of diodes 34–39. A capacitor 42 is connected across all but one of the plurality of diodes, i.e., across diodes. 34–38, with polarity markings the same as diodes 34–39. A switching relay 43, which is associated with the normally closed contact 30, is connected in parallel with the capacitor 42.

Ballasting transformers have typically included a secondary winding to provide continuously controlled operating voltage to the fluorescent lamps to ignite and sustain the arc, and three tertiary windings to provide intermittent heating current to the cathodes during ignition of the arc, plus a common primary winding to energize all of the secondary and tertiary windings. A separate switch is typically associated with each tertiary winding to turn the heating current on and off during ignition of the arc. The tertiary windings must be in immediate proximity with the primary winding, so they are typically wound on the same bobbin with the primary. Since the space available to receive the windings is limited, this practice has necessitated a compromise between the wire size and the number of turns employed, thereby limiting the efficiency of the transformer. Copper losses in the transformer are reduced by increasing the guage of the copper wire utilized in the windings, while magnetic losses are reduced by increasing the number of turns in the windings. Due to the space limitations, a design choice must be made in each case between the guage of the wire and the number of turns employed.

Figure 2:
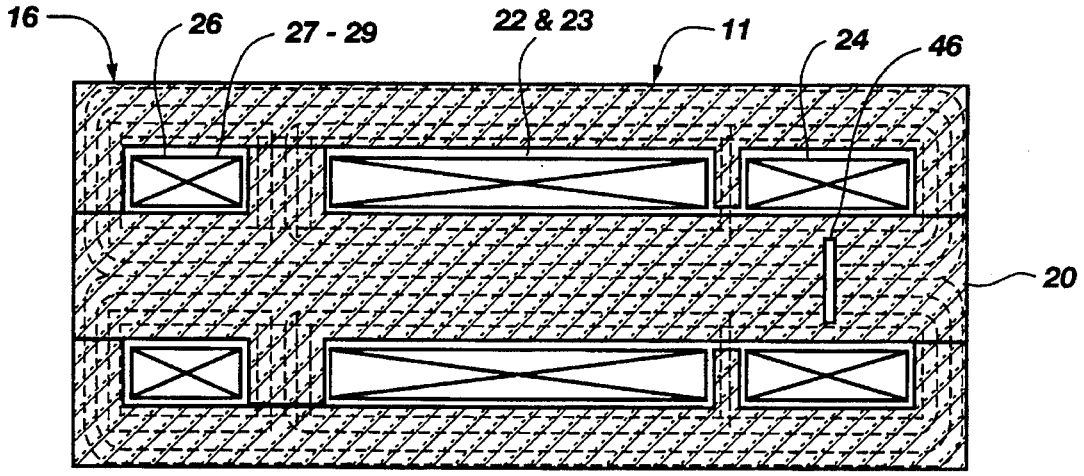
FIG. 2 is an elevation view in section of the low leakage reactance electro-magnetic ballast of the present invention.

Referring to FIG. 2 of the drawing, the ballasting transformer 11 and the heating transformer 16 are illustrated as being wound on a common ferro-resonant core 20. The transformer 11 includes a primary coil 22 and a tertiary coil 23 wound together, and a secondary coil 24 which is wound separately. The heating transformer 16 includes a primary 26 and supplementary windings 27,28,29 which are wound together in a common coil on the core 20. The coils are spaced from each other, but are aligned such that the flux patterns generated by all coils add to each other. Since the heating transformer is switched on and off, the creation of the flux field for it each time it is switched on is aided by the flux fields of the other two coils. Space is available in the primary 22, since the supplementary windings 27–29 are wound with the heating transformer, thus allowing the use of larger guage conductors and more turns, with resultant reduction in copper losses and improved efficiency. For example: in a four foot fluorescent lamp installation, a typical prior art electro-magnetic ballast operates at 0.8 amps and uses 25 guage A.W.G. By comparison, in a similar installation, the present ballast increases the wire size by one full guage, adds 5% more turns on the primary, and operates at 0.5 amps, thus achieving a 20% reduction in both copper and magnetic losses, plus increasing the current carrying capacity by 20%. In the typical electro-magnetic ballast, the magnetic losses, or flux density, can be reduced by increasing the number of turns on the primary, but the inductive energy transfer capability is correspondingly reduced. Therefore, in such ballasts, there is a trade off between magnetic losses and efficiency. However, by the use of the principles disclosed in application Ser. No. 08/125,815, the present invention is able to achieve both a reduction in magnetic losses and a simultaneous improvement in efficiency. The combination of secondary winding 24 and the tertiary winding 23 becomes the equivalent of the reflux winding described in the above application. With the capacitor 25, the tertiary and secondary windings, 23 & 24, are polarized and tuned to net an impedance on the reflux winding which is significantly capacitive. This reactance is reflected through mutual coupling to the primary winding. The reflected capacitive reactance, when divided by its topological coupling with the primary and secondary windings, results in a net reflected impedance that is inductive as viewed by the power supply. The impedances of the primary and secondary windings are thereby matched, thus allowing energy to flow freely between them with a reduction in transformation leakage reactance, etc.

Whether a ballasting transformer has high leakage reactance, as described in U.S. Pat. No. 4,184,233, or has low leakage reactance, as in the present invention, is largely determined by the type of magnetic shunt which is employed to restrict the flux path and cause the core to saturate. Oppositely-directed notches in the sides of the core will produce high leakage reactance and a broad range of harmonics as the flux lines are shunted to the center of the core away from the winding. In contrast, a central slot, such as shown at 46, produces low leakage reactance and a narrow range of harmonics as the flux lines are shunted to the edges of the core close to the winding. Since the core of a ballasting transformer goes into saturation under load each half cycle, with a corresponding increase in impedance in the secondary winding each half cycle, it is virtually impossible to match the impedances of the primary and secondary windings. The tapped winding of the present low leakage reactance auto-transformer performs an essential function, in that, it enables the primary and the secondary to be tuned to the line frequency. This is accomplished by combining the tapped portion of the main winding with the effective magnetic flux underload in the secondary winding to tune the primary winding.

The location of the tap 21 determines the starting voltage of the lamp, in that, it provides increased or decreased voltage to the secondary 24 with respect to the line voltage during the initial phase of each cycle. At the beginning of each cycle, line voltage is applied directly to the primary 22 of transformer 11 and, through normally closed contact 30, to the primary 26 of the cathode heating transformer 16. Supplementary windings 27,28,29 are then energized inductively and current is supplied to heat the cathodes 12,18,19, 13. With the switching array 17, a steady state voltage appears across the capacitor 42 which is equal to the sum of the threshold voltages of diodes 34–38. Diodes 34–38 pass the positive phase of the alternating current and block the negative phase, while diode 41 passes the negative phase and blocks the positive phase. The steady state voltage is stored in capacitor 42 which then supplies current to relay 43. When the voltage level rises above the sum of the threshold voltages of the diodes 34–38, the relay 43 is energized to open contact 30 and interrupt the flow of energy to the primary 26. During the balance of each cycle, operating current is supplied to cathodes 12,13 through connections 44,45 to sustain the arc within the fluorescent tubes.

Referring to FIG. 3*a*, the range of harmonics and magnitude thereof are shown for a typical commercially available electronic ballast. The presence of higher order harmonics, i.e., above the 5th harmonic, is clearly shown. By way of comparison, FIG. 3*b* shows a graph of harmonics present in Applicant's ballasting system. The absence of higher order harmonics is clearly shown, since the 5th to the 15th harmonics are substantially lower and those above the 15th harmonic are avoided.

While the invention has been described with reference to specifically illustrated preferred embodiments, it should be realized that various changes may be made without departing from the disclosed inventive subject matter particularly pointed out and claimed herebelow.

I claim:

1. A ballasting system for fluorescent lamps which includes an elongated laminated iron core having a magnetic shunt which produces low leakage reactance and a narrow range of harmonics, a cathode heating transformer which includes a first winding and three supplementary windings wound together on said core, a low leakage reactance ballasting transformer which includes a main winding on said core adapted to be connected across an a.c. power line, a tap on said main winding dividing it into a primary winding and a tertiary winding, a secondary winding positioned on said core over the magnetic shunt, and means for tuning the combination of the tertiary winding and the effective magnetic flux under load in said secondary winding to the primary winding at the frequency of the a.c. power line.

2. A ballasting system as defined in claim 1 in which the secondary of the ballasting transformer is connected to the tap, and said magnetic shunt is an elongated slot extending parallel to the longitudinal axis of the core.

3. A ballasting system as defined in claim 2 in which the heating first winding and the ballasting main and secondary windings are aligned on the core such that the flux fields of all three are in the same direction and add to each other, whereby the flux fields of the main and secondary windings aid in creating and sustaining the flux field in the heating first winding.

4. A ballasting system as defined in claim 1 which includes a switching array connected in series with the secondary winding and a fluorescent lamp, said array including a plurality of diodes connected in series so as to be similarly conductive in the same direction, and a switching relay connected across all but one of said plurality of diodes, a normally closed contact in series with the first winding of the cathode heating transformer, said contact and first winding being connected between the tap and the a.c. power line, said relay being operatively connected to the contact to interrupt current flow to the cathode heating transformer whenever current from the secondary produces a voltage drop across the diodes which exceeds the sum of the threshold voltages of all but one of the plurality of diodes.

5. A ballasting system as defined in claim 4 which includes a single diode connected in parallel with the plurality of diodes so as to be conductive in its forward direction in opposites polarity to that of the plurality of diodes, and a capacitor connected in parallel with the switching relay with polarity markings the same as the plurality of diodes.

6. A ballasting system for fluorescent lamps which includes a cathode heating transformer and a tuned ballasting auto-transformer separately wound on a low leakage reactance retro-resonant core, means for individually connecting said transformer and said auto-transformer to an a.c. power line, a switching array for detecting voltage above a predetermined level, said switching array being connected to the ballasting auto-transformer and operatively connected to the heating transformer to interrupt the connection of the heating transformer to the a.c. power line whenever current from the ballasting auto-transformer produces a voltage drop which exceeds the predetermined level.

7. A ballasting system as defined in claim 6 in which the ballasting auto-transformer is tuned to the frequency of the a.c. power line.

8. A ballasting system as defined in claim 7 in which the ballasting auto-transformer includes a primary winding, a tertiary winding and a secondary winding, and means for tuning the combination of the tertiary winding and the effective magnetic flux under load in said secondary winding to the primary winding.

9. A ballasting system as defined in claim 8 in which the ballasting auto-transformer includes a main winding adapted to be connected across the a.c. power line, a tap on said main winding dividing it into the primary winding and the tertiary winding, and said secondary winding connected to the tap.

10. A ballasting system as defined in claim 7 in which said switching array includes a plurality of diodes connected in series so as to be similarly conductive in the same direction, and a switching relay connected across all but one of said diodes.

11. A ballasting system as defined in claim 10 which includes a normally closed contact connected between the cathode heating transformer and the a.c. power line, said switching relay being operatively connected to open said contact whenever current from the ballasting auto-transformer produces a voltage drop which exceeds the sum of the threshold voltages of all but one of said diodes.

12. A ballasting system as defined in claim 11 which includes a single diode connected in parallel with the plurality of diodes so as to be conductive in its forward direction in opposite polarity to that of the plurality of diodes, and a capacitor connected in parallel with the switching relay with polarity markings the same as the plurality of diodes.

* * * * *